US010130552B2

(12) United States Patent
Maffei

(10) Patent No.: US 10,130,552 B2
(45) Date of Patent: Nov. 20, 2018

(54) VIBRATING SYSTEM

(71) Applicant: Amedeo Maffei, Sirtori (IT)

(72) Inventor: Amedeo Maffei, Sirtori (IT)

( * ) Notice: Subject to any disclaimer, the term of this patent is extended or adjusted under 35 U.S.C. 154(b) by 475 days.

(21) Appl. No.: 14/654,710

(22) PCT Filed: Dec. 20, 2013

(86) PCT No.: PCT/IB2013/061206

§ 371 (c)(1),
(2) Date: Jun. 22, 2015

(87) PCT Pub. No.: WO2014/102687

PCT Pub. Date: Jul. 3, 2014

(65) Prior Publication Data

US 2015/0305975 A1 Oct. 29, 2015

(30) Foreign Application Priority Data

Dec. 27, 2012 (IT) ..... MI2012A2236

(51) Int. Cl.
*A61H 23/02* (2006.01)
*A47C 1/14* (2006.01)
*A47C 7/02* (2006.01)

(52) U.S. Cl.
CPC ..... *A61H 23/0263* (2013.01); *A47C 1/143* (2013.01); *A47C 7/024* (2013.01);
(Continued)

(58) Field of Classification Search
CPC .... A47C 1/143; A47C 7/024; A61H 23/0263; A61H 2023/0272; A61H 2201/5097;
(Continued)

(56) References Cited

U.S. PATENT DOCUMENTS 5,304,112 A * 4/1994 Mrklas ..... A61M 21/0094 434/236
6,217,533 B1 4/2001 McCambridge
(Continued)

FOREIGN PATENT DOCUMENTS

DE 10353714 A1 6/2004
JP H05-285182 A 11/1993
(Continued)

OTHER PUBLICATIONS

Website: https://www.ncbi.nlm.nih.gov/books/NBK10895/ Archived: 2001 Retrieved: Mar. 19, 2018.*
(Continued)

*Primary Examiner* — Megan Anderson
(74) *Attorney, Agent, or Firm* — Fredrikson & Byron, P.A.

(57) ABSTRACT

A vibrating system for cutaneous stimulation by means of proprioceptive resonance comprises elements (12, 13, 14, 15, 16, 17) for supporting the user's body which are positioned in specific zones for providing support and for specific administration of the proprioceptive stimulation modulation. The supports consisting of separate elements are situated in the nuchal zone, dorso-lumbar zone, buttocks zone, hand zone, popliteal zone and heel zone so as to keep the body supported only in these zones and in a semi-supine position. Each support element, except in some cases the support element (12) for the nuchal zone, is provided with a proprioceptive stimulation vibrating unit (25, 26, 40, 50, 60, 70) for transmitting to precise zones of the body's skin a controlled vibration upon emission of a programmed command from an electronic control unit (22).

21 Claims, 4 Drawing Sheets

(52) U.S. Cl.
CPC ..... *A61H 2023/0272* (2013.01); *A61H 2201/0149* (2013.01); *A61H 2201/0165* (2013.01); *A61H 2201/0192* (2013.01); *A61H 2201/164* (2013.01); *A61H 2201/1609* (2013.01); *A61H 2201/1623* (2013.01); *A61H 2201/1633* (2013.01); *A61H 2201/1635* (2013.01); *A61H 2201/5007* (2013.01); *A61H 2201/5015* (2013.01); *A61H 2201/5035* (2013.01); *A61H 2201/5038* (2013.01); *A61H 2201/5048* (2013.01); *A61H 2201/5097* (2013.01); *A61H 2203/0456* (2013.01); *A61H 2205/04* (2013.01); *A61H 2205/065* (2013.01); *A61H 2205/081* (2013.01); *A61H 2205/086* (2013.01); *A61H 2205/102* (2013.01); *A61H 2205/12* (2013.01)

(58) Field of Classification Search
CPC .... A61H 2201/5048; A61H 2201/5038; A61H 2203/0456; A61H 2205/081; A61H 2205/065; A61H 2205/04; A61H 2205/12; A61H 2205/086; A61H 23/00; A61H 23/02; A61H 23/0254; A61H 2201/0119; A61H 2201/0138; A61H 2201/0142; A61H 2201/0149; A61H 2201/12; A61H 2201/1207; A61H 2201/16; A61H 2201/1604; A61H 2201/1607; A61H 2201/1609; A61H 2201/1611; A61H 2201/1619; A61H 2201/1621; A61H 2201/1623; A61H 2201/1628; A61H 2201/1633; A61H 2201/1638; A61H 2201/1635; A61H 2201/164; A61H 2201/1642; A61H 2201/5002; A61H 2201/5007; A61H 2201/5043; A61H 2201/5046; A61H 2201/5035; A61H 2203/04; A61H 2203/0425; A61H 2203/0438; A61H 2203/0443; A61H 2205/02; A61H 2205/08; A61H 2205/10; A61H 2205/106; A61H 2205/108; A61H 2201/0192; A61H 2201/0165; A61H 2205/102
USPC ..... 601/47
See application file for complete search history.

(56) References Cited

U.S. PATENT DOCUMENTS

| | | | | |
|---|---|---|---|---|
| 7,189,211 | B2 * | 3/2007 | Inada | A61H 23/0254 601/103 |
| 2003/0139693 | A1 * | 7/2003 | Swift | A61G 15/00 601/15 |
| 2006/0217645 | A1 * | 9/2006 | Lockamy | A61G 15/10 601/148 |
| 2008/0104756 | A1 * | 5/2008 | Rawls-Meehan | A47C 20/041 5/613 |
| 2008/0228115 | A1 * | 9/2008 | Racoosin | A61H 23/0263 601/49 |
| 2008/0309132 | A1 * | 12/2008 | Katsuta | A61H 23/02 297/217.3 |
| 2009/0139029 | A1 | 6/2009 | Rawls-Meehan | |
| 2009/0152916 | A1 * | 6/2009 | Lin | A47C 1/032 297/217.3 |
| 2009/0200880 | A1 | 8/2009 | Mortimer et al. | |
| 2009/0264801 | A1 * | 10/2009 | Van der Meer | A61H 1/005 601/70 |
| 2010/0301652 | A1 | 12/2010 | Ballendat | |

FOREIGN PATENT DOCUMENTS

| | | | |
|---|---|---|---|
| JP | 2008173393 | A | 7/2008 |
| JP | 2010537713 | A | 12/2010 |
| WO | 2006079327 | A1 | 8/2006 |
| WO | 2008117330 | A2 | 10/2008 |

OTHER PUBLICATIONS

PCT International Search Report dated May 9, 2014 for Intl. App. No. PCT/IB2013/061206, from which the instant application is based, 7 pgs.
Italian Search Report and Written Opinion dated Aug. 8, 20138 for related IT App. No. MI201222236, 11 pgs.
Keope GPR Studies and publications (summary), 2013-2015, 14 pages.

* cited by examiner

VIBRATING SYSTEM

RELATED APPLICATIONS

This application is a 35 U.S.C. 371 national stage filing from International Application No. PCT/IB2013/061206, filed Dec. 20, 2013, which claims priority to Italian Application No. MI2012A002236, filed Dec. 27, 2012, the teachings of which are incorporated herein by reference.

The present invention relates to an innovative vibrating system and to a method for corporeal stimulation.

In the literature various beneficial effects, both physical and psychological in nature, resulting from stimulation of the cutaneous mechanoreceptors by means of vibration are known. This type of stimulation is, however, somewhat difficult to perform in practice over the whole of the body, since the physical contact between the body and the conventional supports, such as chairs, couches or beds, interferes both with the production and the transmission of the suitable stimulating vibrations and the general sensations perceived by the user. In the first case, in fact, the fixed points defined by the body resting points are not stimulated and may on the contrary have a damping effect on the stimulations which it is attempted to produce in other parts of the body. In the second case, the sensation of contact on the supporting points (which generally cover an area much greater than the zones which can be stimulated by vibration using the known methods) generalizes the attention of the user and lessens, or even eliminates entirely, stimulation of the cutaneous mechanoreceptors to be produced by means of vibration, a large number of these mechanoreceptors being present only in certain well-defined parts of the body.

Some practical attempts to extend stimulation over the whole of the body have produced results which are random and not uniform.

US 2009/0139029 describes for example a bed with a device for producing vibration in sections of the bed. This produces generalized vibrations which cannot be properly controlled over the user's body.

U.S. Pat. No. 6,217,533 describes a generic vibrating device to be placed, for example, underneath the mattress of a bed, on a chair or underneath a cushion. The vibration effect is even more uncontrollable and dispersed.

These systems are not effective for being able to control in a suitable and precise manner the vibrations applied to the body.

In order for the vibration to provide effective stimulation it has in fact been found that it must be administered, depending on the mechanoreceptor to be stimulated, at a given frequency, at a precise amplitude, with a specific acceleration, for a given period of time and in well-defined zones. In fact, only these elements in combination are able ensure ideal activation of the cutaneous mechanoreceptors which are, as stated, sensitive only to a given set of parameters applied. However, the practical embodiments proposed hitherto do not allow full and precise adjustment of these parameters and the results obtained are therefore often limited.

Systems for suspending the body of a user in various ways have also been proposed.

However, they do not deal with the application of controlled vibrations, but only ensure a comfortable and relaxing support system. For example, WO2008/117330, WO2006/079327 and DE10353714 describe support devices on which a user may lie in such a way as to relax the muscles.

The general object of the present invention is to provide a vibrating system and a method which avoid the aforementioned problems and which allow more precise, extensive, variable and effective stimulation of the cutaneous mechanoreceptors by means of vibrations.

In view of this object, the idea which has occurred is to provide, according to the invention, a vibrating system for corporeal stimulation, comprising elements for supporting the user's body which are positioned so as to support separately the nuchal zone, dorsal zone, buttocks zone, hand zone, popliteal zone and heel zone, so as to keep the body supported only in these zones and in a semi-supine position, each support element, except in some cases the support element for the nuchal zone, being provided with a vibrating unit for transmitting to the body a controlled vibration upon emission of a programmed command from an electronic control unit.

The support elements are made of rigid material so as to allow perfect transmission of the signal wave.

Still according to the invention the idea has occurred to provide a method for producing localized vibrations in the body of a user for corporeal stimulation by means of vibrations, comprising suspending the user's body on supports only in the nuchal zone, dorso-lumbar zone, buttocks zone, hand zone, popliteal zone and heel zone, so as to keep the body supported in a semi-supine position and cause vibration of these supports upon operation, except in some cases the support in the nuchal zone, with a controlled vibration frequencies and amplitudes.

Advantageously, as will be clarified below, the support zones and the operating mechanisms are as follows:

- The supports vibrating the heel, for stimulating the cutaneous mechanoreceptors and receptors of the Achilles tendon.
- The supports vibrating the popliteal fossa (zone without fatty part), for stimulating the cutaneous mechanoreceptors of the tendon structure and the ligament structure.
- The supports vibrating the buttocks, for stimulating the vast area where there are numerous cutaneous mechanoreceptors.
- The supports vibrating the palms of the hands, for stimulating the zone where there are numerous cutaneous mechanoreceptors.
- The dorso-lumbar vibrating supports, for stimulating the cutaneous mechanoreceptors and the paravertebral muscles.

In order to illustrate more clearly the innovative principles of the present invention and its advantages compared to the prior art, an example of embodiment applying these principles will be described below with the aid of the accompanying drawings. In the drawings.

Figure 1:
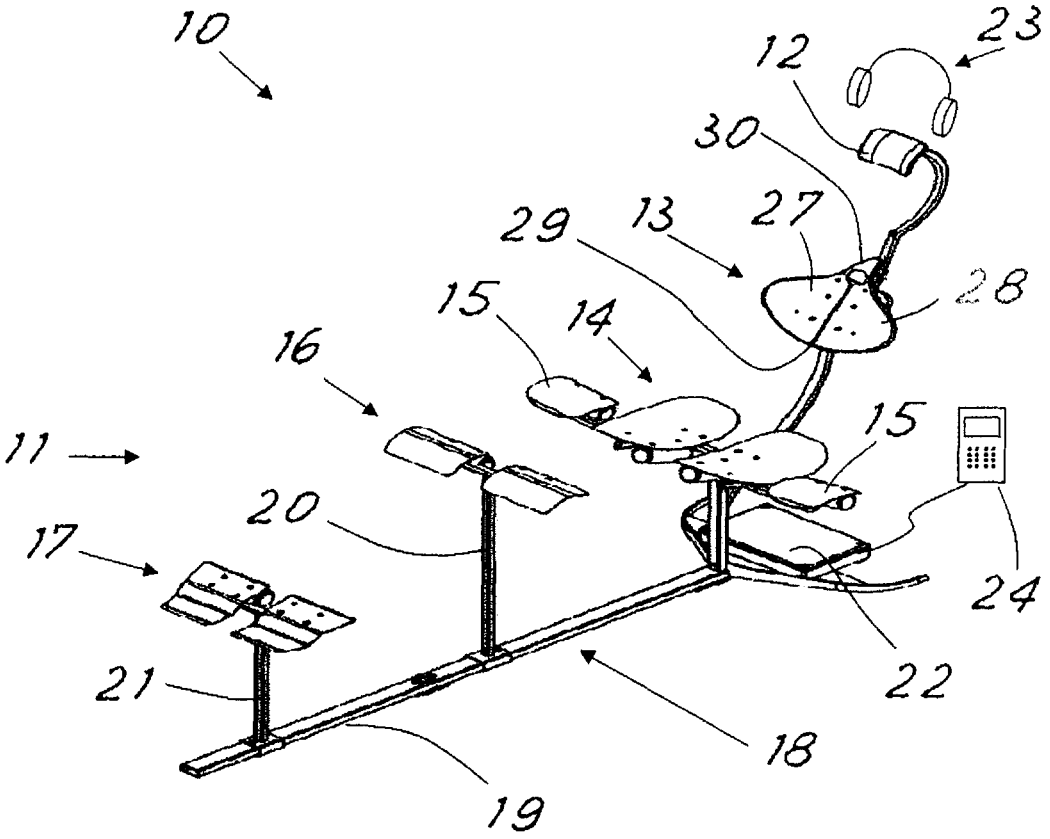
FIG. 1 shows a perspective view of a vibrating system according to the invention.

With reference to the figures, FIG. 1 shows schematically a perspective view of a vibrating system, denoted overall by 10, as provided in accordance with the invention.

This system advantageously allows corporeal stimulation by means of proprioceptive resonance to be performed, as will be clarified below.

This system 10 comprises a structure 11 for supporting the body, which is provided with separate supporting elements which are positioned so as to support the nucha (element 12), the dorsal zone (understood as meaning the dorso-lumbar zone, element 13), buttocks (element 14), hands (elements 15), popliteal zone (elements 16) and the heels (elements 17).

All the elements of the structure are supported by a frame 18 resting on the ground which also maintains the relative position thereof. Advantageously, the frame provides support brackets for the support elements which can be suitably adjusted so as to ensure correct supporting of the aforementioned body zones also when there is a variation in the dimensions and proportions of the user's body. Advantageously, for example at least the longitudinal position of the support element for the heels and/or the support element for the popliteal zone may be adjusted.

In particular, a longitudinal bar or rail 19 may be provided for slidably supporting and fixing uprights 20, 21 for supporting, respectively, the support elements 16 for the knee pit and the support elements 17 for the heels. In this way, it is possible to adjust the horizontal distance of the elements 16 and 17 relative to each other and with respect to the seat formed by the elements 14. Similarly, means for adjusting, for example, the element 12 supporting the nucha may also be provided.

Figure 2:
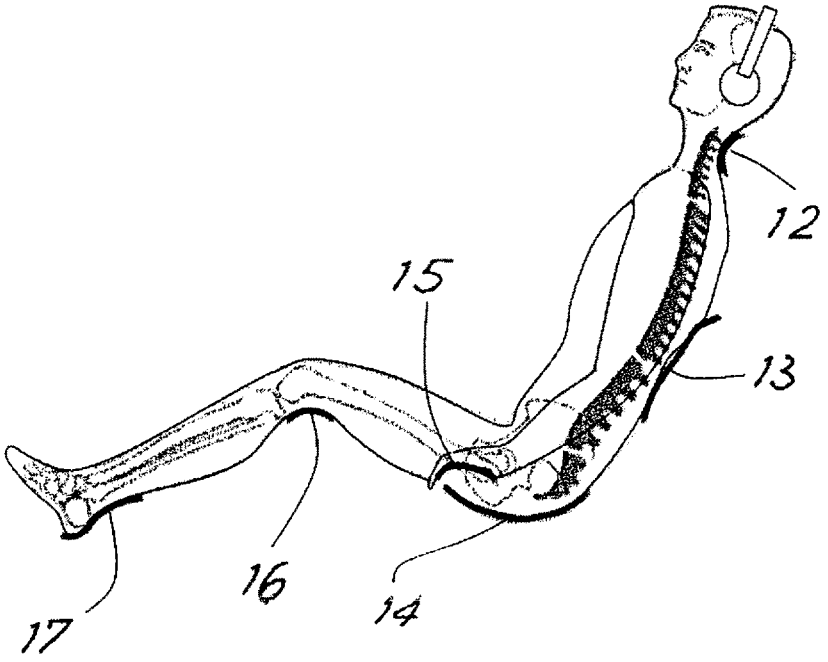
FIG. 2 shows a schematic side view of the body resting on the structure of the system according to FIG. 1.

The semi-supine position assumed by the user's body is shown schematically in FIG. 2.

The inclination of the body is such as to distribute the weight on the supports with almost complete relaxation of both the antagonistic muscles and the agonistic muscles.

Any muscular contraction is thus avoided and a better distribution of the arterial, venous and lymphatic circulation is permitted.

The structure described allows the body to be supported by means of ten predetermined contact points which correspond to precise articular joints. On the other hand, any contact in the area of the calf muscles, thighs, lumbar region, shoulders and cervical region is avoided, thus preventing any form of compression of the cutaneous and lymphatic circulation and the muscle masses.

Such a type of support structure is described (solely for relaxation purposes without any vibration or movement) in application WO2008/117330.

This type of support structure, however, has surprisingly been found to be suitable, together with innovative vibration systems, for providing a vibrating system for applying local vibrations to the supports which are located at different points and which have an effect on the whole of the user's body, as will be described below, with extremely surprising and unexpected results.

According to the principles of the invention, the support elements 13, 14, 15, 16, 17 are provided with suitable vibrating units connected to a central control unit 22.

The support element 12 for the nucha is instead advantageously of the passive type, namely without a vibrating device, so as to avoid stimulation in the vicinity of the cervical zone which may be bothersome.

Administration of the vibrations is performed at the ten points where the body makes contact with the ergonomic support structure. Essentially, these points correspond advantageously to the two palms of the hands, the right-hand and left-hand part of the curvature in the dorso-lumbar region, the popliteal fossae and the two Achilles tendon zones.

Preferably, audio headphones 23 are also provided, being connected to the control unit so as to receive from it audio signals, as will be explained below.

This control unit may be advantageously formed with a microprocessor system, known per se, suitably programmed for the operation of electric motors and for the emission of synchronous audio sounds, as will be explained below.

The control unit 22 may also comprise input means 24 such as, for example, a remote control unit 24 (cable or wireless) for selecting programs and functions of the system 10.

Figure 3:
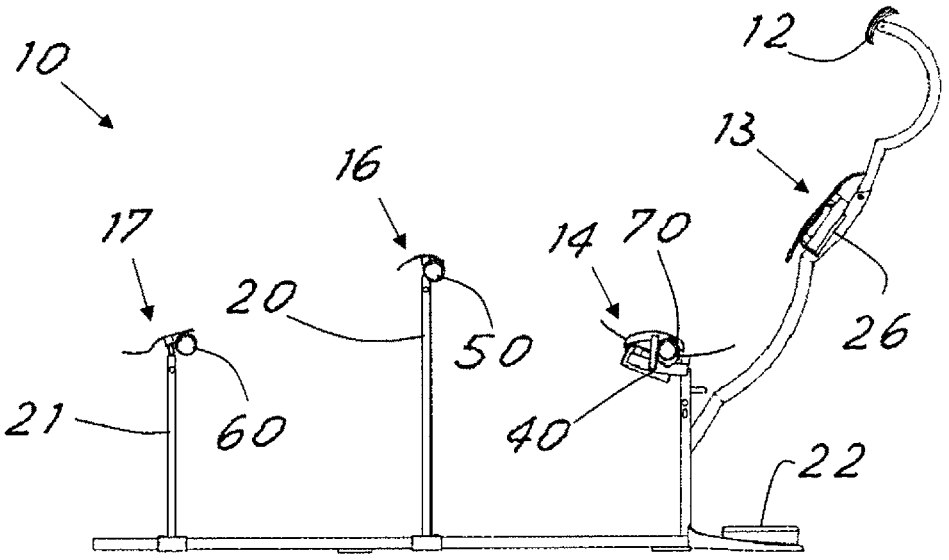
FIG. 3 shows a side view of the system according to FIG. 1.
Figure 4:
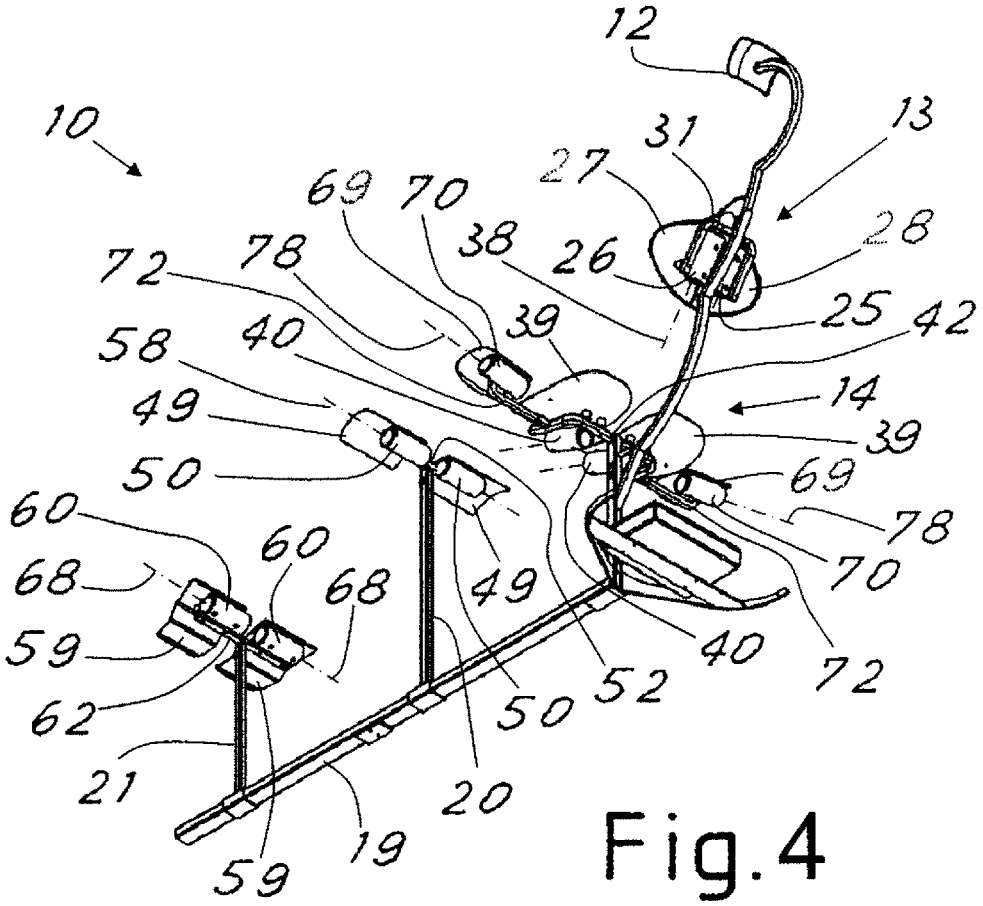
FIG. 4 shows a perspective view, from below, of the system according to FIG. 4.

FIGS. 3 and 4 show more clearly the devices which impart vibration to the support elements. In particular, the support elements comprise a top plate (suitably shaped so as to form a substantially uniform support surface for the given part of the body) with underneath a suitable vibrating unit which imparts a suitable vibration to the plate.

Advantageously, the various vibrating units have structures which are substantially identical to each other and are preferably oriented with their main axis longitudinal or transverse to the support structure, depending on the length of the plate of the support element and their position.

Preferably, each plate of the support elements is resiliently supported on the frame 18 (by means of suitable anti-vibration blocks made of resilient material) so as to be able to vibrate without transmitting the vibrations to the frame and thus prevent the formation of low-frequency harmonic waves. The corresponding vibrating unit is instead rigidly fixed to its plate and is advantageously provided internally with an electric motor which operates a suitable mass causing it to rotate eccentrically about the main axis of the unit.

In this way, the eccentric rotating mass imparts to the respective plate an alternating undulating vibration, the frequency of which depends on the speed of rotation of the motor, which is controlled by the control unit 22. The control unit, by controlling the angle and the direction of rotation of the motor forwards or backwards, may easily adjust the amplitude of the vibration within a wide range of values.

Advantageously, the motors of the vibrating units may be of the brushless type so as to have a low inertia and allow more rapid variations of the speed and the direction of rotation under the operational control of the control unit 22.

Moreover, for better control, each motor may comprise a suitable encoder for feedback control of its movement by the control unit 22.

The motors (which are advantageously low voltage) may be easily operated so as to produce vibrations of the vibrating units with a controlled amplitude and acceleration and a precise frequency, it thus being possible to obtain various operating programs for the system depending on the proprioceptive system which is to be stimulated and subjected to resonance.

Advantageously, the dorsal (or dorso-lumbar) support element is divided into two surfaces, i.e. right-hand surface and left-hand surface, independently vibrating by means of respective vibrating units 25 and 26. For reasons of elasticity and robustness, it has been found to be advantageous if the two surfaces are in any case formed with a single plate partially divided by a suitable incision in the middle.

As can be clearly seen in FIG. 1, the plate of the support element 13 is therefore advantageously divided into a right-hand part 27 and a left-hand part 28 which are separated over most of their longitudinal length by means of a thin incision 29 which terminates in a top zone 30 where the two parts 27 and 28 are left interconnected. The interconnecting part will be designed sufficiently small to ensure sufficient vibrational independence of the two parts, but at the same time a suitably strong support for the dorsal part of the body.

In order to prevent possible breakage, the incision 29 advantageously terminates in a circular hole in the vicinity of the zone 30.

As can be seen again in FIG. 4, the two parts forming the support element 13 are advantageously supported on the frame by means of a rigid U-shaped element 31, with arms of the U directed longitudinally downwards, parallel to the support surface of the element 13. Each part 27 and 28 is suitably fixed to the respective side of the U with blocks made of resilient material arranged in between so as to allow the parts 27 and 28 to vibrate without transmitting the vibration to the frame.

Figure 5:
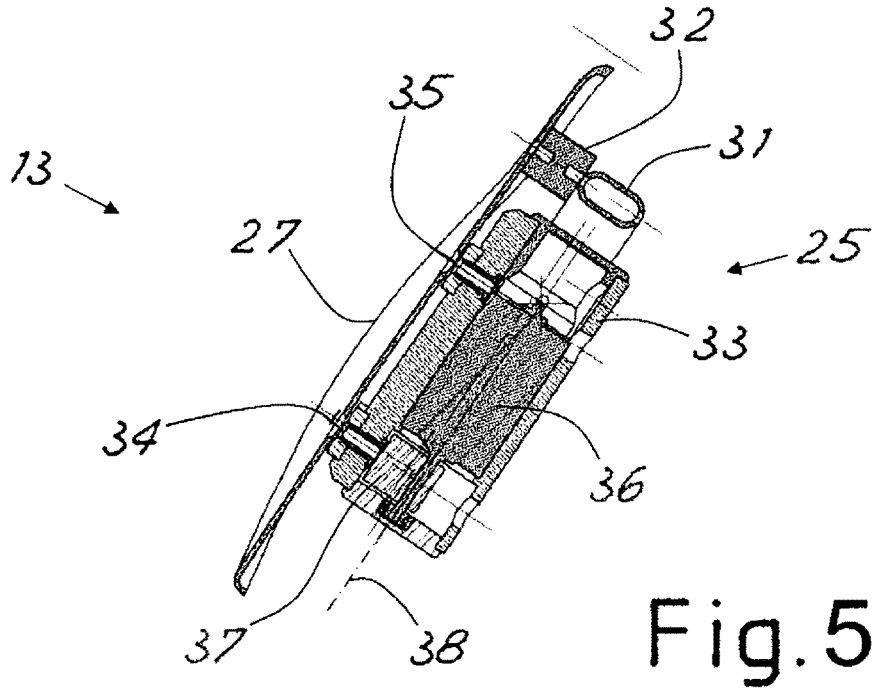
FIG. 5 shows a schematic, longitudinally sectioned view of an element for supporting the dorsal zone in the system according to FIG. 1.

FIG. 5 shows in greater detail the vibrating unit 25 for the part 27 of the element 13 (the other unit is identical for the part 28). This figure also shows one of the resilient blocks (indicated by 32) for supporting the plate on the frame.

In the preferred structure shown here, the vibrating unit comprises a rigid housing 33 connected by means of screws 34 and 35 underneath the respective part 27. The housing, which is advantageously cylindrical, contains an electric motor 36, on the output shaft of which the eccentric mass 37 is mounted so as to rotate about an axis 38 which is substantially parallel to the plate 27 and to the longitudinal axis of the body.

Advantageously, a bearing supports the shaft on the opposite side of the rotating mass 37 in relation to the motor so as to prevent undesirable flexing of the shaft and ensure optimum control of the oscillation.

As can be clearly seen in FIG. 4, the two support elements 14 for the buttocks are coupled together at a suitable transverse distance and each element comprises a shaped plate 39 with a corresponding vibrating unit 40 underneath.

Figure 6:
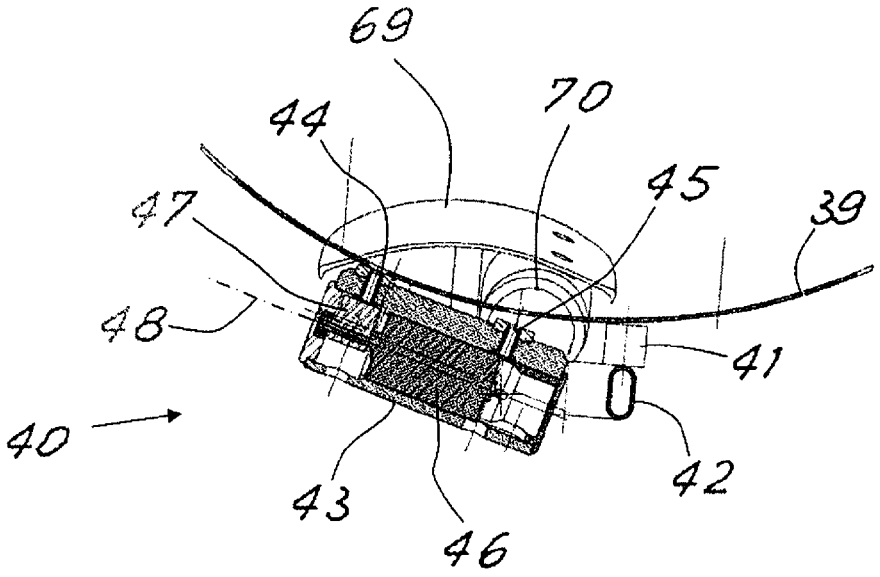
FIG. 6 shows a schematic, longitudinally sectioned view of an element for supporting the buttocks in the system according to FIG. 1.

As also can be seen in greater detail in FIG. 6 for one of the two elements 14 (the other one being symmetrically identical), the plates 39 are resiliently connected to the frame with the arrangement, in between, of suitable resilient spacers (one of which is denoted by 41 in FIG. 6). For this purpose, the frame is advantageously provided with a U-shaped element 42 having arms of the U which are substantially parallel to the plates 39 and to the longitudinal axis of the body, with each plate 39 supported on the respective side of the U.

As can be seen again in FIG. 6, the vibrating unit 40 comprises advantageously a rigid housing 43 connected by means of screws 44 and 45 underneath the respective plate 39.

The housing, which is advantageously cylindrical, contains an electric motor 46, on the output shaft of which the eccentric mass 37 is mounted so as to rotate about an axis 48 which is substantially parallel to the plate and to the longitudinal axis of the body.

Advantageously, a bearing supports the shaft on the opposite side of the rotating mass 47 in relation to the motor so as to prevent undesirable flexing of the shaft.

Figure 7:
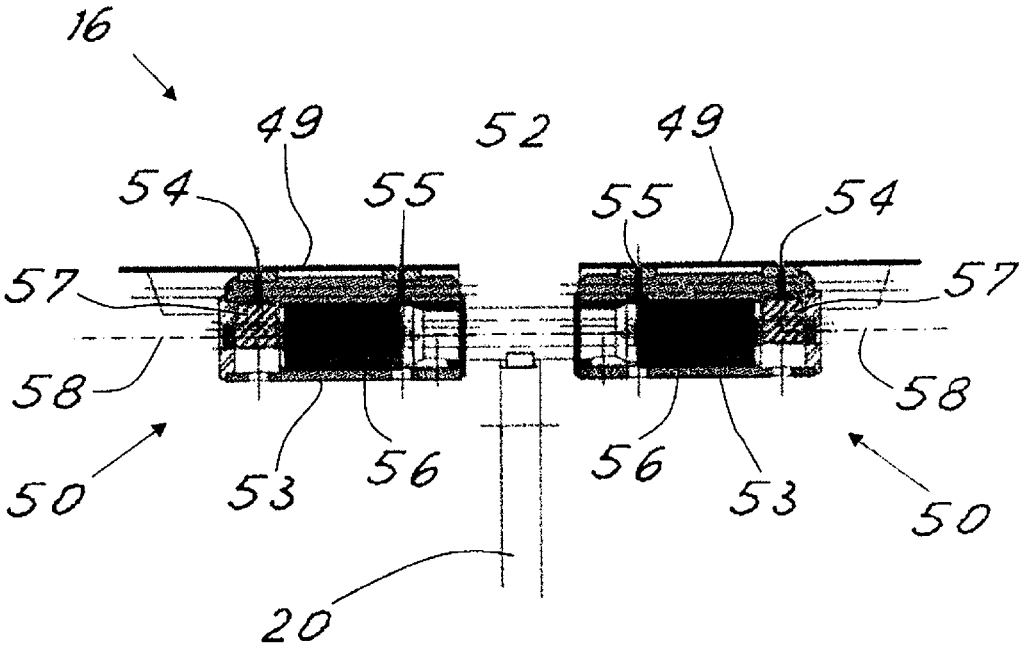
FIG. 7 shows a schematic cross-sectional view of a pair of elements for supporting the heels in the system according to FIG. 1.

FIG. 7 shows in greater detail a possible advantageous embodiment of the support elements 16 which are coupled together at a suitable lateral distance. These elements each comprise a respective shaped plate 49 underneath which the respective vibrating unit 50 is fixed. The plate is resiliently fixed (again by means of suitable resilient spacers) on a transverse bar 52 of the frame, which is in turn supported on the top end of the support element 20.

Each vibrating unit 50 comprises advantageously a rigid housing 53 which is advantageously generally cylindrical and is connected by means of screws 54 and 55 underneath the respective plate 49 and contains the electric motor 56, on the output shaft of which the eccentric mass 57 is mounted so as to rotate about an axis 58 which is substantially parallel to the plate and transverse to the longitudinal axis of the body.

Advantageously, a bearing supports the shaft on the opposite side of the rotating mass 57 in relation to the motor so as to prevent undesirable flexing of the shaft.

As can be seen again in FIG. 7, the two support elements 13 are formed substantially as a mirror image of each other with respect to a vertical and longitudinal plane of the structure.

With reference again to FIG. 4, the two support elements 17 for the heel zone are coupled together at a suitable transverse distance and each comprise a shaped plate 59 with a corresponding vibrating unit 60 underneath. Apart from the shape and relative position of the plates, the elements 17, which are advantageously supported at the ends of a transverse bar 62, are substantially similar to the elements 16 described above and will therefore not be described further since they may now be easily imagined by the person skilled in the art. In a similar manner to the elements 16, the rotating masses of the elements 17 rotate about axes 68 parallel to the plates 59 and transverse to the longitudinal length of the body.

Preferably, the support elements 15 for the hands are also (considered individually) similar to the single elements 16 or 17, except for the shape of their top plate (indicated by 69 in FIG. 4) and will therefore not be described in detail here. These elements 15 are preferably supported on the sides of the U 42, which supports the elements 14 supporting the buttocks, by means of a further frame part 72, at the end of which the shaped plate 69 is resiliently supported.

The respective vibrating unit 70 is fixed underneath the plate 69, with the axis 78 of rotation of the vibrating mass which is directly parallel to the plate and transverse to the body.

It has been advantageously found that the speed of rotation of the eccentric masses usefully ranges between 1500 and 6000 rpm depending on the mechanoreceptor to be stimulated and the effect to be obtained therefrom. Furthermore, the single eccentric masses may advantageously have a weight which is between 10 and 25 grams and, preferably, about 15 to 18 grams (in particular about 17.23 g with an effective eccentric mass of about 15.47 g).

Advantageously, it has also been found to be preferable if the eccentric mass has a diameter of between 10 and 20 mm and preferably about 14 mm, with a rotation about an axis displaced by between 3 and 8 mm (and in particular about 4.5 mm) with respect to its geometric axis. The centre of the eccentric mass may be advantageously at between 4 and 7 mm (and in particular about 5.75 mm) from the geometric axis of the eccentric mass.

With the vibrating systems distributed in a support structure as described above it has been found that it is possible to apply programmed vibration cycles, the stimulation effect of which is transmitted—via the signal which the mechanoreceptors send to the central nervous system and back to the efferent zones (driving effect)—to the whole body and not only to small local zones corresponding to the support points. It has also been found that the specific structure of the vibrating units, together with their position and orientation, is surprisingly effective, despite its simplicity, preventing for example harmonic vibrations which would disturb the overall effect. It has also been found that this structure of the vibrating parts is advantageous for being able to implement vibration programs which may also be complex in nature and are preferably synchronized using exteroceptive proprioception with synchronized modulations and sounds transmitted via the headphones.

The proprioceptive stimulation performed by means of the system described produces an almost immediate effect, owing to self-resonance of the stimulated mechanoreceptors, without the interference and attenuation which would occur in the presence of other passive contact and support zones distributed underneath the user's body.

The strategic position of the plates supporting the body has been found to be most suitable for the action of multiple focal vibration which, via stimulation of the cutaneous mechanoreceptors by the driving effect, acts on several points of the muscle chains and other organs in the human body.

The structure according to the invention allows easy control of the frequency and, in particular of the acceleration ramps, this allowing, also by means of a vibration with a relatively small amplitude, a precise action at the predefined points without creating parasitic harmonic effects and without an invasive vibrating effect in the body structures.

Owing to the system described advantageously it has also been possible to obtain, without difficulty, frequency control of the vibrations within a range of between 15 and 150 Hz and, in particular, between 20 and 140 Hz, so as to obtain a wide range of stimulation effects. For example, depending on the prechosen program and depending on the objective to be achieved, it is possible to generate easily frequencies aimed at producing different stimulation reactions of the so-called Meissner's corpuscles with frequencies of between 20 and 60 Hz, depending on the desired objective, or also frequencies aimed at producing resonance of the so-called Pacinian corpuscles with frequencies of between 90 and 110 Hz, depending on the desired objective.

Moreover, various amplitudes of the vibrations (for example ranging from 1 to 4 mm) may be easily obtained so as to adapt to the desired stimulation effects (for example, in the region of 1.5 mm for stimulation of the Meissner's corpuscles and 2 mm for stimulation of the Pacinian corpuscles).

The structure according to the invention has also proved particularly suitable for controlling the acceleration ramps within a wide range of values. For example, the following ramps have been found to be useful: a ramp of 0 to 40 Hz in 2.5 seconds for initially adapting to the mechanical vibration of the Meissner's corpuscles, a ramp of 0 to 40 Hz in 0.5 seconds for activating the resonance of the Meissner mechanoreceptors, and a ramp of 0 to 90 Hz or 0 to 110 Hz in 0.4 seconds for activating the resonance of the Pacinian mechanoreceptors.

It should also be noted that, with a structure according to the invention, it is possible to act on the skin tissue, excluding the vibration effects in the deeper lying layers of the body, owing to the size of the motors and limited oscillation of the eccentric mass.

Since this vibration is distributed at the points which are most sensitive to proprioception, it may be regarded as being a specific global activator of the skin mechanoreceptors, without producing undesirable vibration effects in the inner lying body parts. The controlled area in which stressing is activated allows specific "activation" of various mechanoreceptors for different results.

The activation of these corpuscles has, for example, the property of stimulating cerebral zones and in particular neurons with high enteroceptive resonance, also called "mirror neurons".

The most evident result, already obtained during the first session, in global stimulation of the Meissner mechanoreceptors, is total muscular repolarisation, i.e. complete relaxation of the muscles, perceived by the user as a general "floating" sensation. This "floating" effect immediately generates a strong sensation of pleasure and is not just a simulated effect, but is indicative of total separation from the bodily perception, due to inhibition of the synapse of the neuromuscular junctions.

Examples of the benefits which can be obtained with the system described and using the various operational possibilities associated with it are remodelling of the skeletal posture, psychological and physical relaxation, muscular relaxation, strengthening of the muscles, increase in muscle tone, relief from stress, increased creative abilities, improved sporting performance, post-performance relief, muscular decontraction, alleviation of back pain, reduction of articular pain, and improved lymphatic, venous and arterial circulation.

The control unit may contain in its memory various programs which can be selected using input means such as a remote control. Further programs may be stored as required, by means of suitable known data and program input interfaces (for example, SD card reader units, USB pens, etc.).

The programs stored in the control unit may for example each have a total duration of between 10 and 20 minutes and, in particular, between 12 and 15 minutes. The duration of the vibrations at given frequencies for a specific effect may be shorter than the entire program, for example with pauses between one vibration cycle at a certain frequency and another cycle, or with cycles at a certain frequency interspersed with other cycles at a different frequency for different effects.

It should be noted, however, that the benefits of the vibration have been found to be maximum when it is administered for a minimum duration of at least 8 minutes and, preferably, at least 10 minutes, but not longer than 20 minutes and preferably, not longer than 15 minutes, following which a tolerance reaction sets in.

Advantageously, the application of this method makes use of the overall involvement of proprioception including the exteroceptive stimulation of the hearing. The guiding voice and harmonic modulations synchronized with the vibrations favour abandonment to the therapy as a result of attenuation of the circular thought patterns and negative emotional states.

The sound recordings may be useful both for the treatment and for instructing the user during the various operational steps. The control unit may store sounds and voices (for example as audio files or as synthesized effects) which are then transmitted through the headphones depending on the program being run by the control unit and are usefully synchronized with the vibration program of the supports.

Advantageously, for one (or each) program, the control unit will have stored in one of its memories one or more tables with data relating to suitable acceleration ramps, times, amplitudes, frequencies, etc., associated with the particular program. During execution of the program, the control unit may thus simply retrieve in sequence at appropriate intervals this data in order to implement the entire programmed cycle.

In particular, for each motor the following may be programmed: the mechanical frequency which is to be produced, the amplitude at which the eccentric mass must rotate, the acceleration ramp which from zero reaches the desired frequency, and the duration of administration. The combined or separate action of the various motors is determined depending on the objective to be achieved (such as repolarisation, muscular strengthening, increase of muscle tone and the like).

Programming of the various parameters for execution of a specific program may be performed on a separate terminal (for example a personal computer) and then transferred to the control unit, or the remote control itself (suitably provided with an input and output interface) may be used, as may be now imagined by the person skilled in the art.

At this point it is clear how the predefined objects have been achieved. With the system and the method according to the invention, stimulation of the cutaneous mechanoreceptors with the consequent desired effects may be effectively applied in a highly precise and programmed manner.

Obviously the description above of an embodiment applying the innovative principles of the present invention is provided by way of example of these innovative principles and must therefore not be regarded as limiting the scope of the rights claimed herein.

For example, the system may be equipped with a more complex control and programming unit, or further motors and other user interfaces may be added. For example vibrating units applied to bandages on the stomach muscles, calf muscles, quadriceps, etc., may be used. In particular, in this way a further six motors with rotating masses may be added.

The invention claimed is:

1. A vibrating system for corporeal proprioceptive stimulation, comprising elements for supporting a body of a user which are positioned so as to support separately, a nuchal zone, a dorsal zone, a buttock zone, a hand zone, a popliteal zone, and a heel zone, so as to keep the body of the user supported only in the nuchal zone, the dorsal zone, the buttock zone, the hand zone, the popliteal zone, and the heel zone and in a semi-supine position, each of the elements for the dorsal zone, the buttock zone, the hand zone, the popliteal zone, and the heel zone being provided with a vibrating unit for transmitting separately, to each of the dorsal zone, the buttock zone, the hand zone, the popliteal zone, and the heel zone of the body of the user a vibration of controlled amplitude and frequency for producing corporeal stimulation of cutaneous mechanoreceptors upon emission of a programmed command from an electronic control unit, wherein the controlled frequency of the vibration ranges between 20 Hz and 140 Hz and the controlled amplitude of the vibration ranges between 1 mm and 4 mm; wherein the vibration of controlled amplitude and frequency is configured to vibrate without interference and attenuation produced by other contacts between the body of the user and the vibrating system so that the corporeal stimulation of the cutaneous mechanoreceptors is precise when produced upon the emission of the programmed command from the electronic control unit.

2. The vibrating system according to claim 1, characterized in that the electronic control unit comprises a memory having stored at least one stimulation program, the at least one stimulation program comprising a duration, an amplitude and a sequence of cycles for the vibration of controlled amplitude and frequency from each of the vibrating units, and comprises an input means for entering a command for selecting the at least one stimulation program from the memory and starting the at least one stimulation program for applying to each of the vibrating units the cycles of the at least one stimulation program.

3. The vibrating system according to claim 2, characterized in that cycles of the at least one stimulation program each comprise an acceleration ramp of the vibration from each of the vibration units.

4. The vibrating system according to claim 3, characterized in that each of the acceleration ramps comprises a duration of between 0.4 seconds and 2.5 seconds.

5. The vibrating system according to claim 4, characterized in that each of the acceleration ramps is chosen from one of a ramp from 0 Hz to 40 Hz in 2.5 seconds, a ramp from 0 Hz to 60 Hz in 0.5 seconds, a ramp from 0 Hz to 90Hz in 0.4 seconds, and a ramp from 0 Hz to 110 Hz in 0.4 seconds.

6. The vibrating system according to claim 1, characterized in that each of the vibrating units comprises an electric motor for rotation of an eccentric mass.

7. The vibrating system according to claim 6, characterized in that the eccentric mass of the vibrating unit for the dorsal zone and the eccentric mass of the vibrating unit for the buttock zone rotate about axes directed longitudinally with respect to the body of the user.

8. The vibrating system according to claim 6, characterized in that the eccentric mass of the vibrating unit for the hands, the eccentric mass of the vibrating unit for the popliteal zone, and the eccentric mass of the vibrating unit for the heel zone rotate about axes directed transversely with respect to the body of the user.

9. The vibrating system according to claim 1, characterized in that the element of the dorsal zone comprises two adjacent surfaces, each of the two adjacent surfaces provided with a separate vibrating unit.

10. The vibrating system according to claim 9, characterized in that the two adjacent surfaces are formed by a shaped plate partially cut along a longitudinal middle incision which is interrupted in a top zone of the shaped plate and forms an elastic joint for the two adjacent surfaces.

11. The vibrating system according to claim 1, characterized in that a position of at least one of the elements with respect to at least one other of the elements is adjustable so as to adapt to different dimensions and proportions of the body of the user.

12. The vibrating system according to claim 11, characterized in that, at least one of the elements of the heel zone or the popliteal zone is movable at least in a longitudinal direction of the body of the user.

13. The vibrating system according to claim 1, characterized in that each of the elements comprises a shaped plate for supporting a corresponding part of the body of the user, with the plate being resiliently supported on a frame and the vibrating unit being fixed underneath the plate.

14. The vibrating system according to claim 1, characterized in that the system further comprises audio headphones for emitting sounds associated with the vibration of controlled amplitude and frequency that is activated.

15. The vibrating system according to claim 1, wherein each of the elements for the nuchal zone, the dorsal zone, the buttock zone, the hand zone, the popliteal zone, and the heel zone is provided with the vibrating unit.

16. A method for producing localized vibrations in a body of a user for corporeal proprioceptive stimulation by vibrations, comprising suspending the body of the user on supports only in a nuchal zone, a dorsal zone, a buttock zone, a hand zone, a popliteal zone, and a heel zone, so as to keep the body of the user supported in a semi-supine position and transmitting a vibration to each of the supports for the dorsal zone, the buttock zone, the hand zone, the popliteal zone, and the heel zone with controlled frequency and amplitude of each of the vibrations for producing corporeal stimulation of cutaneous mechanoreceptors at each of the dorsal zone, the buttock zone, the hand zone, the popliteal zone, and the heel zone of the body of the user, wherein the frequency of each of the vibrations ranges between 20 Hz and 140 Hz and the amplitude of each vibration ranges between 1 mm and 4 mm; wherein each of the vibrations is configured to vibrate without interference and attenuation produced by other contacts between the body of the user and the vibrating system so that the corporeal stimulation of the cutaneous mechanoreceptors is precise when produced upon the emission of the programmed command from the electronic control unit.

17. The method according to claim 16, wherein each of the vibrations is applied with an acceleration ramp.

18. The method according to claim 17, wherein the acceleration ramp is applied from 0 Hz to 40 Hz in 2.5 seconds for initial adaptation to a mechanical vibration of Meissner's corpuscles, from 0 Hz to 60 Hz in 0.5 seconds for activating a resonance of Meissner mechanoreceptors, and from either 0 Hz to 90 Hz or 0 Hz to 110 Hz in 0.4 seconds for activating a resonance of Pacinian mechanoreceptors.

19. The method according to claim 16, wherein the amplitude of each of the vibrations is about 1.5 mm for stimulation of Meissner's corpuscles and about 2 mm for stimulation of Pacinian corpuscles.

20. The method according to claim 16, wherein the corporeal proprioceptive stimulation is directed at one or more of Meissner's corpuscles and Pacinian corpuscles, with the controlled frequency of each vibration at the Meissner's corpuscles ranging between 20 Hz and 60 Hz and the controlled frequency of each vibration at the Pacinian corpuscles ranging between 90 Hz and 110 Hz.

21. The method according to claim 16, wherein each of the supports for the nuchal zone, the dorsal zone, the buttock zone, the hand zone, the popliteal zone, and the heel zone is caused to vibrate upon operation.

* * * * *